US009945225B2

(12) United States Patent
Kabatek

(10) Patent No.: US 9,945,225 B2
(45) Date of Patent: Apr. 17, 2018

(54) SYSTEM FOR MEASURING DOWNHOLE PARAMETERS AND A METHOD OF USING SAME

(71) Applicant: 1434529 ALBERTA LTD., Calgary (CA)

(72) Inventor: Paul Kabatek, Calgary (CA)

(73) Assignee: 1434529 Alberta Ltd., Calgary (CA)

( * ) Notice: Subject to any disclaimer, the term of this patent is extended or adjusted under 35 U.S.C. 154(b) by 262 days.

(21) Appl. No.: 14/707,202

(22) Filed: May 8, 2015

(65) Prior Publication Data

US 2015/0330211 A1 Nov. 19, 2015

Related U.S. Application Data

(60) Provisional application No. 61/994,258, filed on May 16, 2014.

(51) Int. Cl.

| | |
|---|---|
| ***E21B 47/06*** | (2012.01) |
| ***E21B 23/08*** | (2006.01) |
| ***E21B 43/24*** | (2006.01) |
| ***E21B 33/124*** | (2006.01) |

(52) U.S. Cl.

CPC ..... *E21B 47/06* (2013.01); *E21B 23/08* (2013.01); *E21B 33/124* (2013.01); *E21B 43/24* (2013.01); *E21B 43/2406* (2013.01); *E21B 47/065* (2013.01)

(58) Field of Classification Search

CPC ..... E21B 33/124; E21B 47/06; E21B 43/24; E21B 47/065; E21B 43/2406; E21B 47/01

See application file for complete search history.

(56) References Cited

U.S. PATENT DOCUMENTS

2015/0075819 A1* 3/2015 Bujold ..... E21B 23/08 166/387

* cited by examiner

*Primary Examiner* — Brad Harcourt
(74) *Attorney, Agent, or Firm* — Antony C. Edwards

(57) ABSTRACT

The present invention provides a system and method for measuring downhole parameters within a SAGD system. The system includes one or more downhole sensors that are positioned at least within a heel portion of a long production tubing string. Positioning the system within the long production tubing string avoids pulling the sensors to surface each time that the short production tubing string is worked over. The system comprises a ported sub that is threadably connected as part of the long production tubing string. When the tubing string is in a desired position, the ported sub is near the heel portion of the production well. The system further comprises a pumpable sleeve that carries the instrument line downhole into the ported sub. When the pumpable sleeve lands in the ported sub, the instrument line detects information regarding downhole parameters at the heel portion of the production well.

14 Claims, 4 Drawing Sheets

SYSTEM FOR MEASURING DOWNHOLE PARAMETERS AND A METHOD OF USING SAME

FIELD OF INVENTION

This disclosure generally relates to measuring downhole parameters in oil and gas wells. In particular, this disclosure relates to a system and method for measuring downhole parameters in steam assisted gravity drainage systems.

BACKGROUND

Oil production companies extract heavy oil by surface mining or various known in situ techniques. Heavy oil is used herein to refer to oil and/or bitumen that are trapped within oil sands and other forms of petroleum hydrocarbons that demonstrate high viscosities under normal reservoir conditions. One known in situ technique is steam assisted gravity drainage (SAGD).

In a typical SAGD project, two parallel wellbores are drilled from respective surface wellheads into a target reservoir that contains the heavy oil. The target reservoir can be multiple hundreds of meters below the surface. The two wellbores deviate from a generally vertical orientation through a turn section and then the paired wellbores extend substantially horizontally though the targeted reservoir. The section of the wellbore that includes the turn section may be referred to as the heel of the wellbore. The end of the horizontal section that is furthest from the wellhead may be referred to as the toe of the wellbore. The horizontal sections of the two wellbores are typically separated by a several meters, for example around 5 meters, with an upper horizontal wellbore section and a lower horizontal wellbore section.

The wellbores may then be completed with various types of casing and liners to form two completed wells.

Steam is injected into the wellhead that terminates in the upper horizontal wellbore within the target reservoir for thermally mobilizing the heavy oil. This well may be referred to as the injection well. The steam exits the injection well and decreases the viscosity of the heavy oil in the surrounding target reservoir. The less viscous hydrocarbons are then mobilized and flow, under gravity, into the lower well. The lower well is referred to as the production well. The production well typically includes an artificial lift system to pump the collected hydrocarbons, gas, produced water and condensed steam up to surface. The artificial lift systems typically include a downhole pump that is located at or near the heel of the production well.

Within the injection well and the production well, further substantially parallel strings of tubulars may be included. For example, a long tubing string may extend from the wellhead to terminate at or near the toe of the well. The long string provides unrestricted access to the toe of the well. Additionally, a short tubing string may extend from the wellhead and terminate at or near the heel of the well. In this arrangement, steam can be introduced into the toe of the injection well by an injection long tubing string and steam can be introduced in the heel of the injection well by an injection short tubing string. Steam may also be circulated between the long and short injection strings. Similarly, there can be a long production tubing string and a short production tubing string. Typically, the long production string and the short production strings are used to circulate steam within the injection well during start up, which is prior to an injection and production phase.

Some target reservoirs are deep enough below the surface and have sufficient reservoir pressure to produce heavy oil in a free-flowing phase that does not require a downhole pump. In these reservoirs, operators may use a concentric arrangement of the long producing tubing string positioned within the short production string. This concentric arrangement may be used until such time that the reservoir pressure decreases and an artificial lift system is required. At this point, the long production string may be pulled up hole and then reinserted in the parallel arrangement described above and the short string may also be pulled uphole to add the artificial lift system.

Operators of SAGD projects typically detect and measure various downhole parameters, such as pressure and temperature, within the injection well and/or the production well. Some of the known techniques and sensory apparatus for obtaining information regarding the downhole parameters include, but are not limited to: use of blanket gas; bubble tubes; various types of mechanical, electromagnetic and strain gauges; mineral insulated thermocouples; fiber optic cables which may act as sensors; fiber optic cables which may include further separate sensors; or combinations thereof. The information regarding the downhole parameters may be obtained from both of the heel and the toe of the production well.

The measured downhole parameters are used to assist in the operation of the downhole pump within the production well. For example, a pressure sensor that detects changes in a head pressure of a fluid column above the heel of the production well and can provide an indication as to the fluid levels within the production well. If the artificial lift system's pump output is too high, then the fluid levels within the production well may decrease, which may ultimately cause the downhole pump to burnout. Furthermore, if the pump output is too high that may cause the cold point between the injection well and the production well to creep downwards towards the production well. This creep may increase the changes of a steam flash, which can damage the production liner within the production well.

To obtain the measured information regarding the downhole parameters, an instrument line that includes one or more sensors can be inserted into the long production tubing string for detecting and measuring downhole parameters at the toe of the production well. Measurements from the heel of the production well provide pressure and temperature data that is captured in close proximity to the artificial lift system. The sensors for capturing downhole parameter measurements from the heel of the production well are typically externally connected to the outer surface of the short production tubing. However, for various reasons, the short production tubing string often requires one or more work-over procedures. For example, the short production tubing string may have to be pulled out of the production well because downhole pumps often require replacement and maintenance. In order to perform such replacement and maintenance, the downhole pump portion must be pulled up to surface and this work-over procedure can often times damage the sensors that are externally fixed on the short production tubing. Furthermore, the externally connected sensors require external connectors for securing the sensors to the outer surface of the short production tubing string. The external connectors often also get damaged and require replacement during any work over of the short production tubing string.

SUMMARY

The present invention provides a system and method of using the system for measuring downhole parameters within a system for producing heavy oil from a target reservoir. The system may comprise part of a thermal mobilization system such as a SAGD system. The system may include one or more downhole sensors that are positioned within the heel of a long production tubing string within a producer well. The system may be configured to allow the downhole sensors to detect and transmit information regarding one or more downhole parameters that are detectable external to the long production tubing string. Positioning the system within the long production tubing string avoids having to pull some, or all, of the sensory apparatus to surface each time that the short production tubing string is worked over, for example when a downhole pump requires maintenance or replacement. Additionally, positioning the system within the long production tubing string may greatly shorten the time for work-over procedures of the short production string, reduce the costs and the time associated with spooling optical fibers up to, and down from, the surface during work overs. Positioning the system within the long production tubing string may also decrease the costs associated with replacing one of more of the sensors, the optical fibers and the external connectors that connect the sensors to the outer surface of the short production string.

In one embodiment, a system is provided for detecting downhole parameters within a heavy oil production system. For example, the system may comprise part of a steam assisted gravity drainage system that comprises a production well that is positioned proximal to a target reservoir, the production well for collecting thermally mobilized hydrocarbons. The production well comprises a heel portion and a toe portion. The system also includes a short production tubing string and a long production tubing string within the production well. The short production tubing string terminates proximal to the heel portion. The long production tubing string terminates proximal to the toe portion. The long production tubing string comprises a downhole sensor within the heel portion for detecting and transmitting information regarding downhole parameters within a space that is external to the long production tubing string.

In another embodiment, a method for detecting a downhole parameter within a heavy oil production system. The method comprises the following steps of: running a short production tubing string into a completed production well; running a long production tubing string into the completed production well, wherein the long production tubing string comprises a downhole sensor that is positioned proximal a heel portion of the production well; detecting the downhole parameter within the heel portion with the downhole sensor, the downhole parameter is detected within a space that is external to the long production tubing string; and transmitting information regarding the detected downhole parameter to a surface above the target reservoir.

BRIEF DESCRIPTION OF DRAWINGS

Various embodiments of the present invention are described in detail below, with reference to the accompanying drawings. The drawings may not be to scale and some features or elements of the depicted embodiments may purposely be embellished for clarity. Similar reference numbers within the drawings refer to similar or identical elements. The drawings are provided only as examples and, therefore, the drawings should be considered illustrative of the present invention and its various aspects, embodiments and options. The drawings should not be considered limiting or restrictive as to the scope of the invention.

DETAILED DESCRIPTION

Figure 1:
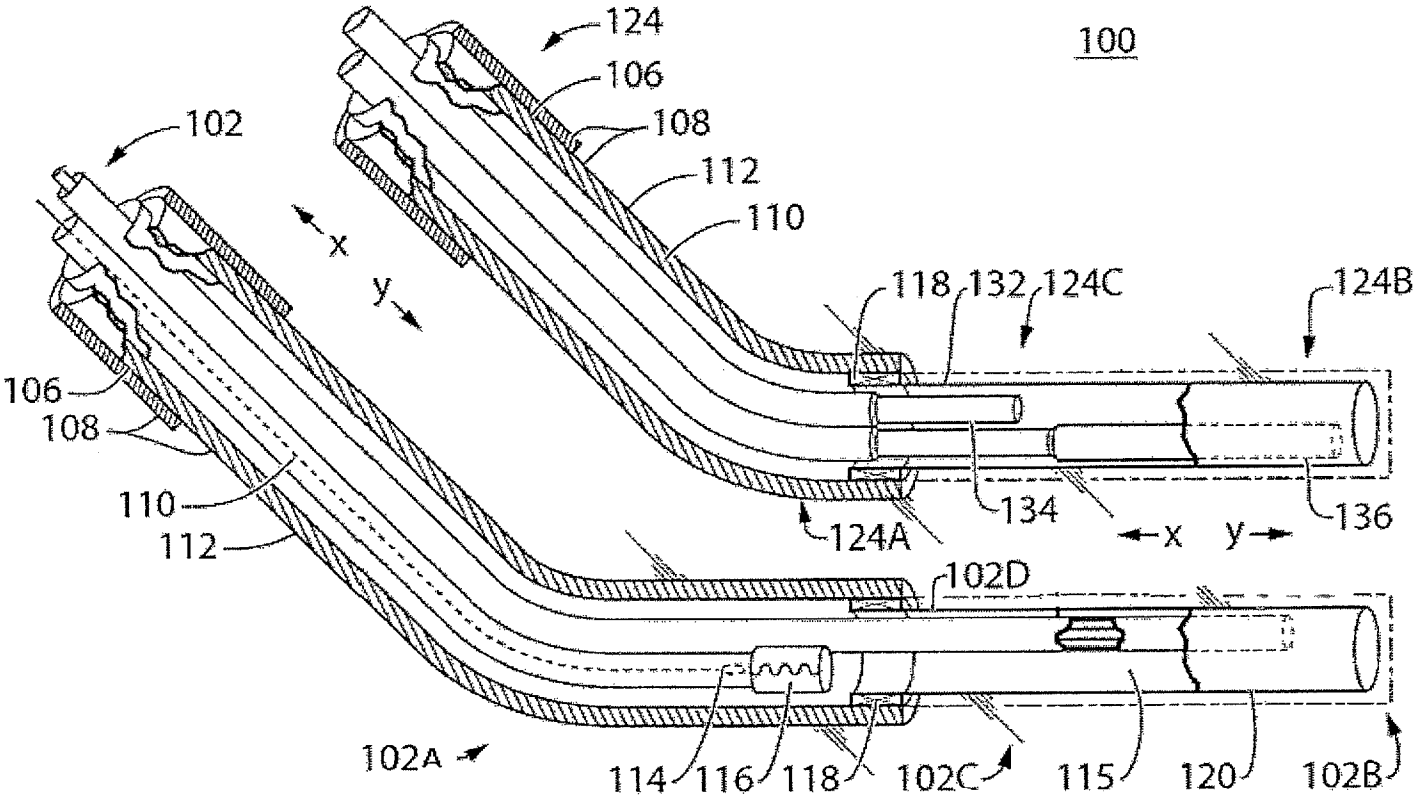
FIG. 1 PRIOR ART
FIG. 1 is a side view of a schematic of a downhole portion of a prior art steam assisted gravity drainage system with an injector well and a producer well.

FIG. 1 depicts a downhole portion of a typical steam assisted gravity drainage system 100. The system 100 includes a production well 102 and an injection well 124. The arrows that are labelled X in the FIG. 1 depict a direction towards surface, which is also referred to as the uphole direction. The arrows that are labelled Y in FIG. 1 depict the direction away from surface, which is also referred to as the downhole direction. While not depicted, a skilled person would understand that a target reservoir that contains heavy oil is located in proximity to substantially horizontal portions (102C, 124C) of the wells 102, 124.

The production well 102 comprises a wellbore that is drilled from the surface to define a heel portion 102A, a toe portion 102B and the substantially horizontal portion 102C therebetween. Both of the production well 102 and the injection well 124 may be lined with different types of casing and liners. As will be appreciated by one skilled in the art, casing and liners are provided as a string of threadably interconnected tubulars that, at least, provide structural support for stabilizing the wellbore and possibly also for isolating various sections of the wellbore. The arrangement of specific casing and liners that may be employed in a given SAGD system is typically determined by the geology of each well and the target formation. In one example, the production well 102 includes a first casing 106. The first casing 106 may also be referred to as surface casing. The first casing 106 extends through the wellbore from near the surface to near the heel portion 102A. For example, the first casing 106 may have an internal diameter of about 406.4 mm. The first casing 106 may be secured in position by cementing and other methods known to those skilled in the art.

The first casing 106 may house a second casing 112. The second casing 112 may also be referred to as an intermediate casing. The second casing 112 may extend, within the first casing 106, from near the surface into an area proximal the target reservoir. In this fashion, the second casing 112 may be with the heel portions 102A and at least part of the toe portions 102B of the production well 102. For example, the second casing 112 may extend past the heel portion 102A and only partially through the horizontal portion 102C towards the toe portion 102B (FIG. 1). In one example, the second casing 112 may be thermally engineered. In another example, the second casing 112 may have an internal diameter of about 298.5 mm. The second casing 112 may be secured in the desired position by cement 108, for example thermal cement that is flexible, or not.

The downhole terminus of the second casing 112 may comprise a production liner 120 that extends towards the toe portion 102B. The production liner 120 may also be referred to as a horizontal liner. The production liner 120 may be secured to the second casing 112 by a seal 118 such as a thermal debris seal barrier or similar means. The barrier may be able to compensate for expansion and contraction of the downhole tubulars. For example, the seal 118 may be able to move so that expansion of the second casing 112 and the production liner 120, which occurs when downhole temperatures increase, does not damage the second casing 112 or the production liner 120. The production liner 120 may be connected at or near the downhole terminus of the second casing 112. The production liner 120 may comprise various means for controlling the entry of sand into the production liner 120. The various different apparatus, systems and methods for achieving this sand control means will be appreciated by those skilled in the art. In one example, the production liner 120 may have an internal diameter of about 219.1 mm.

The second casing 112 may house a short production tubing string 110 and a long production tubing string 112. The short production tubing string 110 may also be referred to as the short production tubing string and the heel production tubing string. The long production tubing string 112 may also be referred to as the long producing tubing string and the toe producing tubing string.

The short production tubing string 110 may terminate at or near the heel portion 102A. The short production tubing string 110 may have an internal bore that is in fluid communication with a fluid output of a downhole pump assembly 116. The downhole pump assembly 116 may be part of an artificial lift system that provides energy to fluids within the production liner 120 to pump the fluids uphole to the surface via the internal bore of the short production tubing string 110. As will be appreciated by one skilled in the art, the downhole pump assembly 116 may be a variety of known, and not yet known, pumps such as electric submersible pumps, progressive cavity pumps and hydraulic pumps.

As depicted in FIG. 1, the short production tubing string 110 further comprises a first sensor array 114 that is connected to an outer surface of the short production tubing string 110 proximal to the downhole pump assembly 116. The first sensor array 114 may detect, measure and collect information regarding downhole parameters such as pressure, temperature or both within the space between the outer surface of the short production tubing string 110 and an inner surface of the second casing 112. In particular, the first sensor array 114 detects and collects downhole parameter information in an area that is proximal to the heel portion 102A. The first sensor array 114 may transmit the collected downhole parameter information uphole to one or more displays on surface.

The long production tubing string 112 may terminate at or near the toe portion 102B. The long production tubing string 112 may also have an internal bore that houses a second sensor array 115. Similar to the first sensor array 114, the second sensor array 115 may detect, collect and transmit downhole parameter information in an area that is proximal to the toe portion 102B and/or within the horizontal portion 102C.

The injection well 124 has many of the same features as the above described production well 102. For example, the injection well 124 comprises a wellbore that is drilled from surface to define a heel portion 124A, a toe portion 124B and a substantially horizontal portion 124C therebetween. In one example, the injection well 124 also comprises first casing 106, second casing 112 both of which may be held in position by cement 108, or not. The injection well 124 may also comprise an injection liner 132. Similar to the production liner 120, the injection liner 132 may include a sand control means and the injection liner 132 may be connected to the second casing 112 by the seal 118 or a similar means. For example, the injection liner 132 may be connected at or near the downhole terminus of the second casing 112. The injection well 124 may also comprise a short injection tubing string 134 and a long injection tubing string 136 within the second casing 112 and the injection liner 132. In one example, the short injection tubing string 134 may provide steam from surface to the region of the target reservoir that is proximal to the heel portion 124A and the long injection tubing string 136 may provide steam to the region of the target reservoir that is proximal to the toe portion 124B. In another example, either the short injection tubing string 134 or the long injection tubing string 136 may provide steam to the target reservoir.

Figure 2:
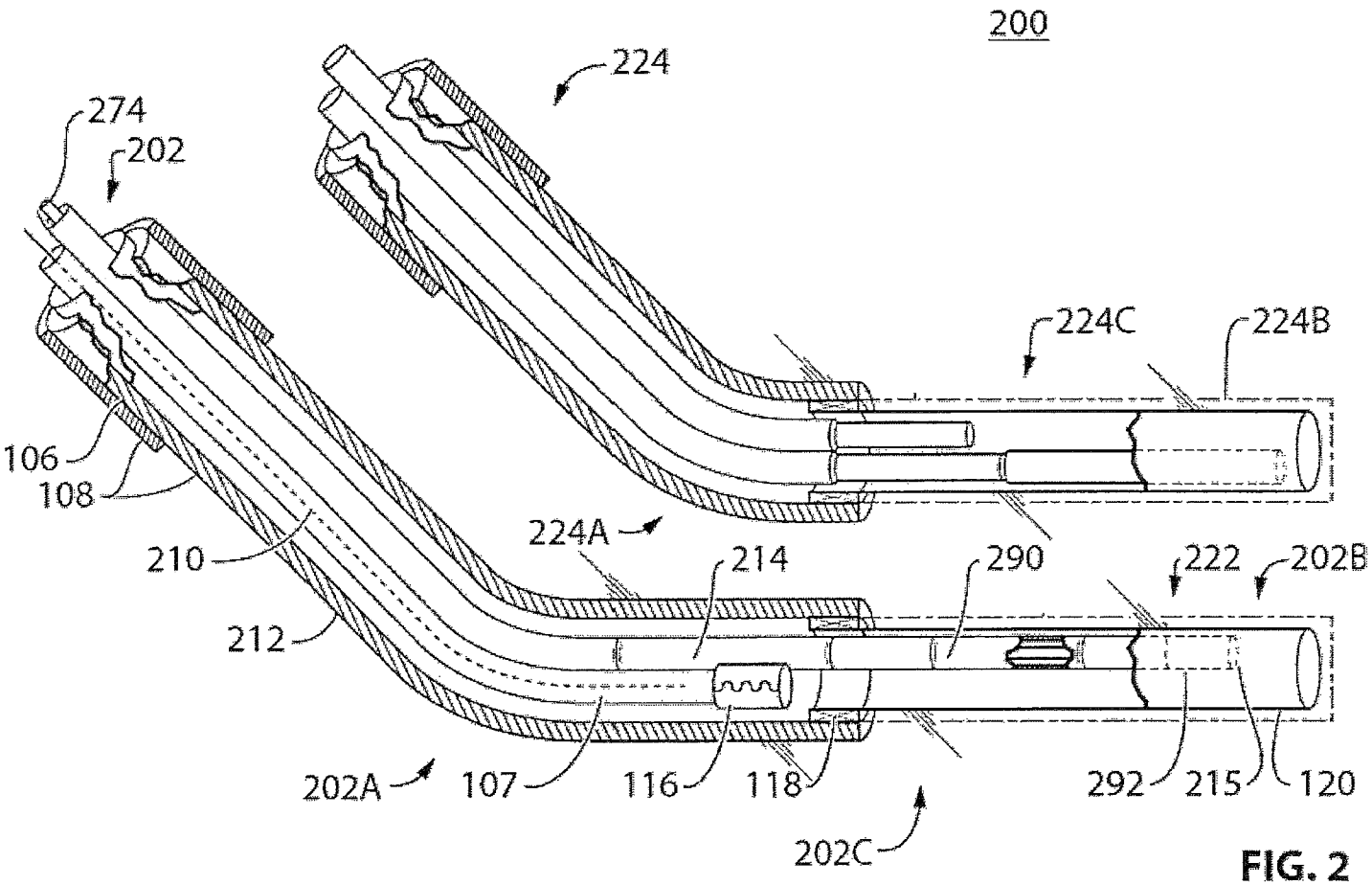
FIG. 2 is a side view of a schematic of a downhole portion of a steam assisted gravity drainage system with an injector well and one embodiment of a producer well.

FIG. 2 depicts one embodiment of the present invention that comprises a SAGD system 200. The system 200 comprises an injection well 224 and a production well 202 that are similar to those described above.

The injection well 224 may comprise many of the same features as the prior art injection well 124 described above. For example, the injection well 224 comprises a heel portion 224A, a toe portion 224B and a horizontal portion 224C. At least part of the injection well 224, for example the toe portion 224B and portions of the horizontal portion 224C may be positioned proximal to the target reservoir and the injection well 224 is configured to provide steam from surface into the target reservoir.

The production well 202 may comprise many of the same features as the prior art production well 102 described above. For example, the production well 202 comprises a heel portion 202A, a toe portion 202B and a horizontal portion 202C. The production well 202 is configured to collect fluids that are mobilized within the target reservoir and pump those fluids uphole to the surface.

In one embodiment, the production well 202 comprises a short production tubing string 210 and a long production tubing string 222 that are at least partially housed within a second casing 212. As described above for the prior art second casing 112, the second casing 212 extends from the surface casing and terminates in, or proximal to, the heel portion 202A or in the horizontal portion 202C. The short production tubing string 210 extends from surface and terminates proximal the heel portion 202A. The short production tubing string 210 has an internal bore that is in fluid communication with the fluid output of the downhole pump assembly 116, which is similarly positioned proximal to the heel portion 202A. The short production tubing string 210 conducts the fluid output from the downhole pump assembly 116 uphole, for example to the surface. The short production tubing string 210 does not necessarily include a sensor assembly. Optionally, the short production tubing string 210 may include a sensor assembly.

The long production tubing string 222 comprises a perforated joint 290, a restriction 292 and a ported sub 214, and that are each threadably connected within the tubulars that make up the long production tubing string 222. In one embodiment, the perforated joint 290 may be connected within the long production tubing string 222 between the restriction 292 and the ported sub 214. Preferably, the perforated joint 290 is positioned close to, possibly adjacent, the restriction 292. Further tubulars may be connected within the long production tubing string 22 and interspersed between two or all of the perforated joint 290, the restriction 292 and the ported sub 214, or not. When the long production tubing string 222 is run into the production well 102 and the second casing 212, the long production tubing string 222 may come to reside in a desired position. In the desired position, the restriction 292 may be positioned in, or proximal to, the toe portion 202B. The restriction 292 may provide a restricted aperture, or narrowed opening, at or near the toe portion 224B of the long production tubing string 222. The restriction 292 may also be referred to as a bullnose. The ported sub 214 may also be referred to as a ported seal bore landing nipple. In the desired position, the ported sub 214 may be positioned proximal to the downhole pump assembly 116. In one embodiment, when the long production tubing string 222 is in the desired position, the ported sub 214 may be substantially adjacent or abeam the downhole pump assembly 116 (see FIG. 2).

Figure 3:
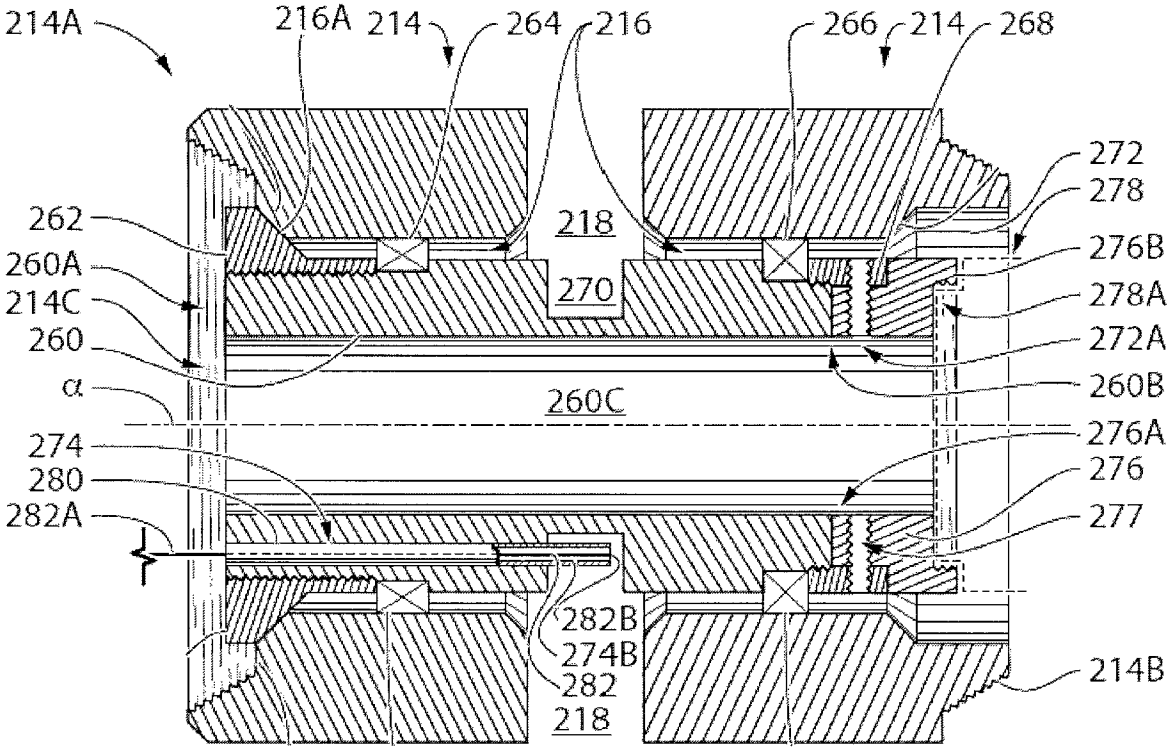
FIG. 3 is a mid-line cross-sectional view of one embodiment of pumpable sleeve in use with a ported sub in a production tubing string of a steam assisted gravity drainage system.

The ported sub 214 is a tubular with an uphole end 214A, a downhole end 214B and an inner bore 214C therebetween. The ported sub 214 defines one or more ports 218 that provide fluid communication between outside of the ported sub 214 and the inner bore 214C. In one embodiment, the ported sub 214 comprises four diametrically opposed ports 218. Other embodiments of the ported sub 214 may include more or less ports 218. The ported sub 214 may also include an internal profile 216 that narrows the cross-sectional area of the inner bore 214C. In one embodiment, the internal profile 216 extends into the inner bore 214C and reduces the inner diameter of the ported sub 214. FIG. 3, which is not intended to be limiting, depicts the internal profile 216 as comprising a no-go shoulder 216A that comprises a face that is at approximately a 45-degree angle relative to the longitudinal axis of the ported sub 214 (see line $\alpha$ in FIG. 3). As will be appreciated by those skilled in the art, the specific angle of the no-go shoulder 216A may not be important to how the present invention functions.

A pumpable sleeve 260 is also provided. The pumpable sleeve 260 is configured to provide a first instrument line 274 in proximity to the downhole pump assembly 116. The pumpable sleeve 260 may be a tubular device that can be positioned within the long production tubing string 222, for example by pumping the pumpable sleeve 260 down from the surface. The pumpable sleeve 260 has an uphole end 260A, a downhole end 260B and an inner bore 260C that extends between the two ends 260A, B. When the pumpable sleeve 260 is positioned within the ported sub 214, the inner bores 214C, 260C are in fluid communication with each other at the uphole end 260A of the pumpable sleeve 260.

In one embodiment, the pumpable sleeve 260 may comprise a locating mandrel 262, an uphole seal 264, a downhole seal 266 and a downhole mandrel 268. The locating mandrel 262 may be threadably connected to the uphole end 260A and the downhole mandrel 268 may be threadably connected to the downhole end 260B of the pumpable sleeve 260. The uphole seal 264 may be received and held in position between the locating mandrel 262 and an uphole external shoulder of the pumpable sleeve 260. The downhole seal 266 may be held in position between a downhole external shoulder of the pumpable sleeve 260 and the downhole mandrel 268. Alternatively, an outer surface of the pumpable sleeve 260 may define glands for receiving each of the seals 264, 266 in their respective positions adjacent, or near, to the locating mandrel 262 and the downhole mandrel 268. As would be appreciated by one skilled in the art, the seals 264, 266 may be O-rings or other types of sealing members that are made from materials that can withstand the temperature, pressure and other elements, for example the presence of sour gas ($H_2S$), that may be within the downhole environment of the SAGD system 200.

The pumpable sleeve 260 may further comprise a recess 270 that is defined on the external surface of the pumpable sleeve 260 and the recess 270 circumferentially extends around the pumpable sleeve 260. The recess 270 may be positioned between the seals 264, 266.

The pumpable sleeve 260 also comprises the first instrument line 274 that has an uphole end 274A and a downhole end 274B. The first instrument line 274 is connected to the pumpable sleeve 260 with the uphole end 274A extending from surface and the downhole end 274B extending into the recess 270. FIG. 3 depicts the first instrument line 274 as passing through a channel within a sidewall of the pumpable sleeve 260. The first instrument line 274 may include a sensor array 282 and a protective shroud 280 that protects the sensor array 282 from the harsh elements of the downhole environment. For example, the protective shroud 280 may be a tube of stainless steel, or other rigid material that extends through a longitudinal channel in the sidewall of the pumpable sleeve 260. The protective shroud 280 may be fixed within the side wall channel of the pumpable sleeve 260 by various means, for example a connector, such as a threaded connector, that connects to the side wall channel at the uphole end 260A of the pumpable sleeve 260. The sensor array 282 in FIG. 3, which is not intended to be limited, depicts a portion of the protective shroud 280 cut away to reveal the sensor array 282 therewithin. The sensor array 282 may be configured to detect information regarding the downhole parameters, such as pressure and/or temperature, and communicate the detected information to the surface. The downhole parameters may be detecting by the sensor array 282 within a space that is external to the long production tubing string 222. The sensor array 282 may include various different types of sensors and means of transmitted the detected information. In one embodiment, the sensor array 282 may comprise optical fibers that act as both a sensor and a transmission line for transmitting the information regarding the downhole parameters to the surface. In one embodiment, the sensor array 282 may comprise one or more optical fibers. For example, the sensor array 282 may comprise a cable that is made up of a plurality of optical fibers. In another embodiment, the optical fibers may cooperate with a further sensor that detects the information regarding the downhole parameters and the optical fibers transmit that information to the surface.

In one embodiment, the pumpable sleeve 260 may further comprise a shear sub assembly 272. For example, the shear sub assembly 272 may be releasably connected to the downhole end 260B of the downhole mandrel 268. The shear sub assembly 272 is configured to provide a second instrument line 275 in proximity to the toe portion 202B of the production well 202.

Figure 4:
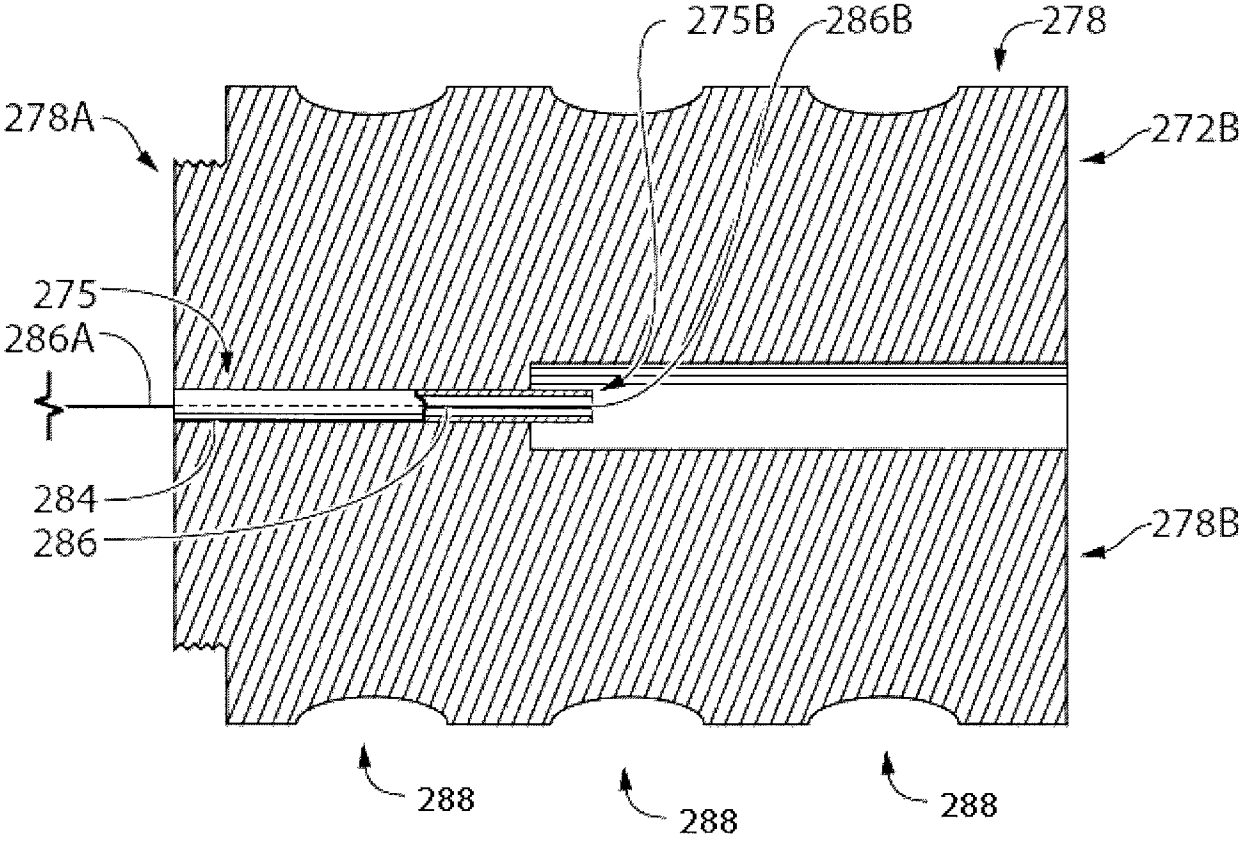
FIG. 4 is a mid-line cross-sectional view of a pump-down sub for use with the pumpable sleeve 260 in FIG. 3.

In one embodiment, the shear sub assembly 272 may have a substantially closed uphole end 272A and an open downhole end 272B. A second instrument line 275 may also be connected to the shear sub assembly 272 (shown in FIG. 3). The second instrument line 275 may comprise the same elements as the first instrument line 274 and it may detect and transmit the same downhole parameters as the first instrument line 274, or different downhole parameters. For example, the second instrument line 275 may comprise an uphole end 275A, a downhole end 275B (see FIG. 4) a protective shroud 284 and a second sensory array 286. In one embodiment, the protective shroud 284 and the secondary sensory array 286 are substantially similar to the protective shroud 280 and sensory array 282 described above. The uphole end of the second instrument line 275 extends from the surface, through the substantially closed uphole end of the shear sub assembly 272 with the downhole end 275B extending into, or through the open downhole 275B end of the shear sub assembly 272. The shear sub assembly 272 may be released from the pump-down sleeve 260 by various means, for example by the use of shearable members, and the shear sub assembly 272 may conduct the secondary instrument line 275 further downhole within the long production string 222, for example proximal to the toe portion 202B of the production well 202. Optionally, a portion of the shear sub assembly 272 may have one or more dimples 288, or scalloped recesses, defined by the outer surface of the shear sub assembly 272. The dimples 288 may retain fluids to provide lubrication for when the shear sub assembly 272 is travelling down the long production tubing string 222.

In one embodiment, the shear sub assembly 272 may comprise a shear sub 276 and a pump-down sub 278. The shear sub 276 may be an annular collar with an uphole end 276A and a downhole end 276B. The uphole end 276A may be releasably connected to the downhole end 260B of the downhole mandrel 268. For example, the shear sub 276 may be connected to the downhole mandrel 268 by one or more shear members 277. The shear sub 276 may be connected at the downhole end 276B to an uphole end 278A of the pump-down sub 278, for example by a threaded connection. The pump-down sub 278 may also be referred to as a pump-down pig. In one embodiment, the pump-down sub 278 may be degradable, for example chemically degradable or thermally degradable. The uphole end 278A of the pump-down sub 278 may be substantially closed and a downhole end 278B of the pump-down sub 278 may be open. As depicted in FIG. 5, which is not intended to be limiting, the second instrument line 275 extends through the substantially closed uphole end 278A and into the open downhole end 278B. In this embodiment, the uphole end 272A of the shear sub assembly 272 may be defined by the uphole end 276A of the shear sub 276 and the downhole end 272B of the shear sub assembly 272 may be defined by the downhole end 278B of the pump-down sub 278.

In other embodiments, either or both of the sensor arrays 282, 286 may detect the downhole parameters in a space that is external to the long production tubing string 222 but the instrument line 274 is not required. For example, the sensor array 282 may transmit the detected information regarding the downhole parameters by one or more wireless methods, such as wireless communication, cooperation with a mud pulse motor, electromagnetic telemetry systems or other means that will be appreciated by a person skilled in the art.

In operation, heavy oil hydrocarbons can be mobilized within a target reservoir by drilling the injection well 224 and the production well 202. Both wells may be completed by casing the wells with the casing 206 from surface and the second casing 212 from the end of the casing 206. The casings 206, 212 may be securing in place by cementing. The second casing 212 may only extend partially into the horizontal portions 202C, 224C of the wells 202, 224. The remainder of the wells 202, 224 may be uncased and considered open-hole. The open-hole portions of the wells 202, 224 may be lined with liners 120, 136. The liners 120, 136 providing sand control through the open-hole portions of the wells 202, 224.

When the wells 202, 224 are so completed, a step of running in the short production tubing string 210 in the downhole direction Y into the second casing 212 of the production well 202 may be performed. In one embodiment, the short production tubing string 210 may include a downhole pump assembly 116 that comes to rest at a desired position at, or proximal to, the heel portion 202A.

Next a step of making up the long production tubing string 222 occurs by threadably connecting a plurality of tubulars. The plurality of tubulars may include the perforated joint 290, the restriction 292 and the ported sub 214. The long production tubing string 222 is made up in a desired configuration so that when the long production tubing string 222 is run into the production well 202 into the desired position, the ported sub 214 is positioned at, or proximal to, the heel portion 202A and substantially adjacent or abeam the downhole pump assembly 116. With the desired configuration of the long production tubing string 222, at the desired position, the restriction 292 will be positioned at, or proximal to, the toe portion 202B and the perforated joint 290 will be positioned proximal to the restriction 292.

When the long production tubing string 222 is in the desired position, a next step may be inserting the pumpable sleeve 260 into the long production tubing string 222 and positioning the pumpable sleeve 260 within the ported sub 214. For example, the pumpable sleeve 260 may be pumped into the long production tubing string 222 in the downhole direction Y with the assistance of pressurized fluids that are delivered into the production well 202 at the surface. During the step of positioning the pumpable sleeve 260 within the ported sub 214, the pumpable sleeve 260 will engage the internal profile 216 of the ported sub 214 and the pumpable sleeve 260. The engaging of the pumpable sleeve 260 with the ported sub 214 may also be referred to as a step of landing the pumpable sleeve 260. In one embodiment, the locating mandrel 262 may come into direct contact with the no-go shoulder 216A of the internal profile 216. When landed, the seals 264, 266 are configured to engage and seal against the internal profile 216. When the seals 264, 266 engage and seal against the internal profile 216, fluid communication across the seals 264, 266 is restricted or prevented. When landed, the recess 270 will substantially align with the one or more of the ports 218 and the downhole end 274B of the instrument line 274 may be in fluid communication with the port 218 and the space within the second casing 112 of the production well 202. When the recess 270 is aligned with the one or more ports 218, a discrete sensor window is defined so as to allow the instrument line 274 to detect and transmit information regarding one or more of the downhole parameters from within a space that is external to the long production tubing string 222, and optionally within the second casing 212 of the production well 202.

In embodiments that include the shear sub assembly 272, the next step may be introducing pressurized fluids down the long production tubing string 222 that are at a sufficient pressure that they will release the shear sub assembly 272 from the downhole end 260B of the pumpable sleeve 260. For example, the pressurized fluids may provide sufficient energy that pushes against the substantially closed uphole end 272A of the shear sub assembly 272, the one or more shear members 277, such as shear pins, will shear and the shear sub assembly 272 will flow down the long production tubing string 222 to end up within the toe portion 202B. The shear sub assembly 272 will come to rest against, or adjacent the restriction 292. The restriction 292 will prevent the shear sub assembly 272 from exiting the open downhole end of the long production tubing string 222. Fluids that are displaced as the pumpable sleeve 260 and/or the shear sub assembly 272 move through the long production string 222 may exit the long production tubing string 222 by the restriction 292 and the perforated joint 290.

When the first instrument line 274 is in fluid communication with the port 218, the first instrument line 274 can perform the steps of detecting and transmitting information regarding the downhole parameters within the heel portion 202A of the production well 202. The first instrument line 274 may perform the steps of detecting and transmitting information regarding the downhole parameters within a space that is external to the long production tubing string 222 and proximal to the downhole pump assembly 116. In one embodiment, the first instrument line 274 detects and transmits information regarding the pressure and/or temperature within the second casing 212 at the heel portion 202A.

In embodiments that include the second instrument line 275, the second instrument 275 can be positioned to be in fluid communication with the open downhole end 272B of the shear sub assembly 272. The second instrument line 275 can perform the steps of detecting and transmitting information regarding the downhole parameters within the toe portion 202B of the production well 202. The instrument lines 274, 275 may be controlled by a user sending commands from surface as to when to begin the step of detecting and the step of transmitting. Furthermore, the user on surface may command the instrument lines 274, 275 regarding which specific downhole parameters will be detected and for how long.

In an embodiment where the first instrument line 274 comprises optical fibers, the optical fibers may be delivered into the long production tubing string 222 by spooling off the optical fibers into the production well 202, from a spooling device at the surface, as the pumpable sleeve 260 is moved in the downhole direction Y and as the pumpable sleeve 260 comes to be positioned within the ported sub 214. In an embodiment where the second instrument line 275 comprises optical fibers, the optical fibers may also be spooled into the production well 202 from the surface. If the long production tubing string 222 requires any make over procedures, the optical fibers may be spooled uphole on to the spooling device on the surface.

In another embodiment, the method described above may also be used when the long production tubing string 222 is positioned within the short production string 210. For example, if the target reservoir has a reservoir pressure that is sufficiently high to allow for free-flowing production of thermally mobilized heavy oil, the operator may still desire to measure the downhole parameters at the heel 202A of the production well 202. The ported sub 214 may be included in the long production tubing string 222 during the make up step. The ported sub 214 may be positioned within the long production tubing string 222 so that when in the desired position, the ported sub 214 is proximal to the heel portion 202A. The pumpable sleeve 260 can then be positioned within the ported sub 214 so that the first instrument line 274 detects and transmits information regarding the downhole parameters of interest.

In another embodiment where the long production tubing string 222 is positioned within the short production tubing string 210, the pumpable sleeve 260 may further include the shearable sub assembly 274 and the second instrument line 275, as described above. In this embodiment, the operator may receive information regarding downhole parameters at both the heel portion 202A and the toe portion 202B of the production well 202.

While the above disclosure describes certain examples of the present invention, various modifications to the described examples will also be apparent to those skilled in the art. The scope of the claims should not be limited by the examples provided above; rather, the scope of the claims should be given the broadest interpretation that is consistent with the disclosure as a whole.

What is claimed is:

1. A system for detecting downhole parameters within a heavy oil production system, the system for detecting downhole parameters comprising:
   a. a production well that is positioned proximal to a target reservoir, the production well for collecting mobilized hydrocarbons from the target reservoir, the production well comprising:
      i. a heel portion and a toe portion;
      ii. a short production tubing string that terminates proximal to the heel portion;
      iii. a long production tubing string that terminates proximal to the toe portion, the long production tubing string comprising:
         a downhole sensor in fluid communication with the heel portion for detecting and transmitting information regarding downhole parameters within a space that is external to the long production tubing string and proximal to the heel portion,
         a pumpable sleeve positionable within the long production tubing string,
         a shear sub assembly releasably connected to a downhole end of the pumpable sleeve by one or more shear members, the shear sub assembly comprising a second downhole sensor, a shear sub and a pump-down sub, the shear sub being threadably connected to the pump-down sub which includes a substantially closed uphole end and an open downhole end, and wherein when the shear sub is released from the pumpable sleeve, the second downhole sensor fluidly communicates with the toe portion through the open downhole end of the pump-down sub for detecting and transmitting information regarding downhole parameters within a space that is external to the long production tubing string and proximal to the toe portion.

2. The system of claim 1, wherein the long production tubing string further comprises a ported sub that is positioned proximal to the heel portion, the ported sub comprising an inner bore, an interior profile and defining at least one port that provides fluid communication between the inner bore and external to the long production tubing string.

3. The system of claim 2 wherein the pumpable sleeve is engagable with the interior profile and wherein the pumpable sleeve comprises the downhole sensor and defines a recess that is alignable with the at least one port, and when the recess is aligned with the at least one port the downhole sensor is in fluid communication with the heel portion.

4. The system of claim 3, wherein the pumpable sleeve further comprises a downhole seal and an uphole seal and the recess is defined therebetween.

5. The system of claim 1, wherein the long production string further comprises a restriction that is positioned within the toe portion.

6. The system of claim 5, wherein the long production tubing string further comprises a perforated joint between the ported sub and the restriction, the perforated joint being proximal to the restriction.

7. The system of claim 1, wherein the downhole sensor is a pressure sensor for detecting pressure within the space that is external to the long production tubing string.

8. The system of claim 1, wherein the downhole sensor is an optical fiber pressure sensor for detecting pressure within the space that is external to the long production tubing string.

9. The system of claim 1, wherein at least part of the long production tubing string extends through an uncased portion of the production well, wherein the uncased portion of the production well comprises a liner for providing sand control.

10. The system of claim 1, wherein the heavy oil production system is a steam assisted gravity drainage system.

11. A method of detecting downhole parameters within a heavy oil production system, the method comprising steps of:

a. running a short production tubing string into a completed production well;

b. running a long production tubing string into the completed production well; the completed production well positioned proximal to a target reservoir c. conducting a downhole sensor through the long production tubing string to a heel portion of the production well by a pumpable sleeve, d. providing a shear sub assembly that is releasably connected to a downhole end of the pumpable sleeve, wherein the shear sub assembly comprises a second downhole sensor, a shear sub and a pump-down sub, and wherein the shear sub is threadably connected to the pump-down sub, and wherein the pump-down sub includes a substantially closed uphole end and an open down hole end;

e. detecting a first downhole parameter within the heel portion with the downhole sensor, the first downhole parameter is detected within a space that is external to the long production tubing string and proximal to the heel portion;

f. releasing the shear sub assembly from the pumpable sleeve;

g. conducting the shear sub assembly through the long production tubing string to a toe portion of the production well;

h. detecting a second downhole parameter within the toe portion with the second downhole sensor, the second downhole parameter is detected within a space that is external to the long production tubing string and proximal to the toe portion, the second parameter being detected through the open downhole end of the pump-down sub.

12. The method of claim 11, further comprising steps of: landing the pumpable sleeve within a ported sub of the long production tubing string.

13. The method of claim 11, further comprising steps of: transmitting information regarding the detected first and second downhole parameters to a surface above the target reservoir.

14. The method of claim 11, wherein the first and second downhole parameters are selected from a group consisting of pressure and temperature.

* * * * *